US007918308B2

(12) United States Patent
Cohen

(10) Patent No.: US 7,918,308 B2
(45) **Date of Patent: *Apr. 5, 2011**

(54) SOUND AND VIBRATION TRANSMISSION PAD AND SYSTEM

(76) Inventor: Daniel E. Cohen, Eden Prairie, MN (US)

( * ) Notice: Subject to any disclaimer, the term of this patent is extended or adjusted under 35 U.S.C. 154(b) by 78 days.

This patent is subject to a terminal disclaimer.

(21) Appl. No.: 12/465,501

(22) Filed: May 13, 2009

(65) Prior Publication Data

US 2009/0250982 A1 Oct. 8, 2009

Related U.S. Application Data

(63) Continuation of application No. 10/943,186, filed on Sep. 16, 2004, now Pat. No. 7,553,288, which is a continuation-in-part of application No. PCT/US2004/007354, filed on Mar. 10, 2004.

(60) Provisional application No. 60/453,549, filed on Mar. 10, 2003, provisional application No. 60/493,645, filed on Aug. 7, 2003, provisional application No. 60/518,973, filed on Nov. 10, 2003.

(51) Int. Cl.
*A61H 23/02* (2006.01)

(52) U.S. Cl. ..... 181/150; 181/160; 601/47; 297/217.4; 297/452.37

(58) Field of Classification Search ..... 181/150, 181/144, 145, 147, 153, 160, 161, 167, 169; 600/27, 28; 601/46, 47, 48, 49, 56, 57, 58, 601/64; 381/301, 105, 106, 108, 151, 190, 381/351, 388; 297/452.13, 452.37, 217.4
See application file for complete search history.

(56) References Cited

U.S. PATENT DOCUMENTS

| | | | |
|---|---|---|---|
| 2,338,551 | A | 1/1944 | Stanko |
| 2,468,205 | A | 4/1949 | Kellogg |
| 2,616,971 | A | 11/1952 | Kannenberg |
| 3,009,991 | A | 11/1961 | Bekey |
| 4,023,566 | A | 5/1977 | Martinmaas |
| 4,038,499 | A | 7/1977 | Yeaple |
| 4,064,376 | A | 12/1977 | Yamada |
| 4,254,303 | A | 3/1981 | Takizawa |
| 4,306,115 | A | 12/1981 | Humphrey |
| 4,458,362 | A | 7/1984 | Berkovitz et al. |
| 4,507,816 | A | 4/1985 | Smith, Jr. |
| 4,583,245 | A | 4/1986 | Gelow et al. |
| 4,602,337 | A | 7/1986 | Cox |

(Continued)

FOREIGN PATENT DOCUMENTS

JP 63073799 A 4/1988

(Continued)

OTHER PUBLICATIONS

PCT/US05/33354 International Search Report and Written Opinion.

(Continued)

*Primary Examiner* — Elvin G Enad
*Assistant Examiner* — Jeremy Luks
(74) *Attorney, Agent, or Firm* — Aleya R. Champlin; Audrey J. Babcock; Briggs and Morgan, P.A.

(57) ABSTRACT

The present invention is directed to a pad and sound transmission system which is adapted to directly transmit audible sound waves into the body at high intensity levels. In one embodiment, the subject invention includes a back pad and a seat pad. Each pad includes a speaker module having an acoustic speaker disposed within the pad and surrounded by a plurality of different layers.

20 Claims, 11 Drawing Sheets

U.S. PATENT DOCUMENTS

| | | | |
|---|---|---|---|
| 4,628,530 | A | 12/1986 | Op De Beek et al. |
| 4,778,027 | A | 10/1988 | Taylor |
| 4,888,808 | A | 12/1989 | Ishikawa et al. |
| 5,046,101 | A | 9/1991 | Lovejoy |
| 5,076,260 | A | 12/1991 | Sasaki et al. |
| 5,086,755 | A | 2/1992 | Schmid-Eilber |
| 5,097,821 | A | 3/1992 | Eakin |
| 5,101,810 | A | 4/1992 | Skille et al. |
| 5,113,852 | A | 5/1992 | Murtonen |
| 5,132,942 | A | 7/1992 | Cassone |
| 5,143,055 | A | 9/1992 | Eakin |
| 5,165,017 | A | 11/1992 | Eddington et al. |
| 5,314,403 | A | 5/1994 | Shaw |
| 5,355,419 | A | 10/1994 | Yamamoto et al. |
| 5,368,359 | A | 11/1994 | Eakin |
| 5,387,026 | A | 2/1995 | Matsuhashi et al. |
| 5,404,115 | A | 4/1995 | Johnson |
| 5,434,926 | A | 7/1995 | Watanabe et al. |
| 5,450,494 | A | 9/1995 | Okubo et al. |
| 5,520,873 | A | 5/1996 | Liene |
| 5,530,761 | A | 6/1996 | D'Alayer de Costemore d'Arc |
| 5,550,922 | A | 8/1996 | Becker |
| 5,666,426 | A | 9/1997 | Helms |
| 5,687,244 | A | 11/1997 | Untersander |
| 5,844,992 | A | 12/1998 | Boyer |
| 5,865,771 | A | 2/1999 | Shuto et al. |
| 5,887,071 | A | 3/1999 | House |
| 5,895,348 | A | 4/1999 | Hosaka |
| 5,902,167 | A | 5/1999 | Filo et al. |
| 5,907,622 | A | 5/1999 | Dougherty |
| 6,023,801 | A | 2/2000 | Lamm |
| 6,027,463 | A | 2/2000 | Moriyasu |
| 6,104,820 | A | 8/2000 | Soza |
| 6,267,721 | B1 | 7/2001 | Welles |
| 6,369,312 | B1 | 4/2002 | Komatsu |
| 6,500,134 | B1 | 12/2002 | Cassone |
| 6,529,605 | B1 | 3/2003 | Christoph |
| 2002/0066142 | A1 | 6/2002 | Osborne et al. |
| 2004/0021351 | A1 | 2/2004 | House |

FOREIGN PATENT DOCUMENTS

| | | | |
|---|---|---|---|
| JP | 5137630 | | 6/1993 |
| JP | 8104297 | A | 4/1996 |
| JP | 09-234231 | | 9/1997 |
| JP | 2001112829 | | 4/2001 |
| JP | 2001120632 | | 5/2001 |
| JP | 2002262960 | A | 9/2002 |
| KR | 873443 | | 3/1987 |

OTHER PUBLICATIONS

PCT/US04/07354 International Search Report and Written Opinion.
PCT/US08/085776 International Search Report and Written Opinion.

SOUND AND VIBRATION TRANSMISSION PAD AND SYSTEM

RELATED APPLICATIONS

This application is a continuation of U.S. patent application Ser. No. 10/943,186, filed on Sep. 16, 2004, which is a continuation-in-part of PCT patent application Ser. No. PCT/US2004/007354, filed on Mar. 10, 2004, which claims the benefit of priority of U.S. Provisional Application No. 60/453,549, filed on Mar. 10, 2003, and U.S. Provisional Application No. 60/493,645, filed on Aug. 7, 2003, and U.S. Provisional Application No. 60/518,973, filed on Nov. 10, 2003, which applications are all hereby incorporated by reference in their entireties.

FIELD OF THE INVENTION

This invention relates to a pad, chair or similar body-supporting apparatus for sitting on, reclining on or lying upon. More specifically, the invention relates to a pad, chair or similar apparatus capable of transmitting amplified sound and vibrations generated by a sound source to a user's body.

BACKGROUND OF THE INVENTION

Exposure to sound and vibration also occurs when watching and listening to TV, a movie, playing video games or listening to music. When a person participates in such activities, very little of the sound energy and vibration impacts their physical body directly or is transmitted into their body and therefore there is little tactile stimulation. When the participant receives more tactile stimulation there is a greater likelihood that they will become more attentive to their body and the stimulus that is inducing the sound and vibration. Therefore, during TV viewing and/or listening to music or a soundtrack and playing video games another sensory modality (touch) can be stimulated in the participant thereby enhancing the experience. Video gaming is further enhanced using this invention as tactile cueing provides additional information. This affords the user a faster response time as vibratory stimuli can trigger a very fast reflex arc.

Movie theaters typically use high volume sound sources to partially create such an effect. Oftentimes the sound will exceed a safe sound level of 85 decibels (OSHA 3074). Moviegoers therefore may experience harmful effects related to their hearing. People however, frequently enjoy the movie theater experience in part because the higher volume of sound creates more physical and emotional feeling through sound and vibration, which enhances alertness and attentiveness. The higher level of alertness and attentiveness causes the moviegoer to become more engaged in the movie and when the moviegoer leaves the theater, he or she is often aware of a heightened state of arousal and awareness.

However, not all people prefer to experience sound at the same volume level. Some people prefer lower volume, while others prefer higher volume. When more than one person is watching and listening to TV or a movie or listening to music there is often disagreement as to how loud the volume should be in the shared environment. Consequently, there is a need in the art for a method and apparatus which enables a person to experience the sound without the need to either raise or lower the audible volume level of the sound.

SUMMARY OF THE INVENTION

The present invention is directed to a pad, chair assembly or other similar piece of furniture that is capable of transmitting amplified sound and vibrations generated by a sound source to a user's body. In one embodiment, the subject invention includes a chair having a back pad and a seat pad. Each pad is comprised of a covering layer, surrounding foam, and a speaker module. The speaker module is disposed within the pad and is surrounded by the covering layer and the surrounding foam.

In one embodiment, the covering layers is comprised of a top and bottom layer. Both layers are designed to be very compressible to conform to the user's head or back for comfort purposes and to allow sound and vibration energy to pass with minimal attenuation and obstruction. The top covering layer is made of a highly porous material through which sound and vibrations can readily penetrate. The bottom covering layer lies just under the top layer and is made of a fiber that also has limited sound and vibration filtering.

In one embodiment, the speaker module includes a number of layers to form chambers around the speakers (resonant chambers) and provide orientation and support for the speakers. The resonant chamber space is air-filled between the speaker and a resonating layer.

In one embodiment, the speakers are connected to an amplifier. The amplifier of the present invention can accept audio output from a sound source such as a VCR, DVD, CD or MP3 player, or other electronic devices that have audio output capabilities. The audio output of the amplifier can be sent to the user's TV or stereo receiver (connected to other external speakers) instead of or in addition to the pad. The amplifier includes an automatic volume adjustment mechanism which adjusts the volume of the sound to be transmitted through the pad(s), chair and air.

The present invention creates a heightened state of arousal and awareness without sound levels that are considered unsafe (OSHA 3074). Just as music that is heard stimulates the auditory cortex directly, music and sound that is felt directly as more intense vibration by the person's body stimulates the much larger somatosensory cortex, thereby simultaneously impacting more of the brain's primary sensory cortex. Stimulating both areas simultaneously and in conjunction with the primary visual cortex when watching TV or a movie or playing video games creates a cascade effect in the brain by increasing the level of neuronal excitation in the related association cortical areas and throughout the brain. Therefore, with the greater brain activation that is achieved due to greater tactile stimulation there results greater alertness, awareness, attentiveness and stimulation.

BRIEF DESCRIPTION OF THE DRAWINGS AND FIGURES

For purposes of facilitating and understanding the subject matter sought to be protected, there is illustrated in the accompanying drawings an embodiment thereof. From an inspection of the drawings, when considered in connection with the following description, the subject matter sought to be protected, its construction and operation, and many of its advantages should be readily understood and appreciated.

DETAILED DESCRIPTION OF THE PREFERRED EMBODIMENTS

Figure 1:
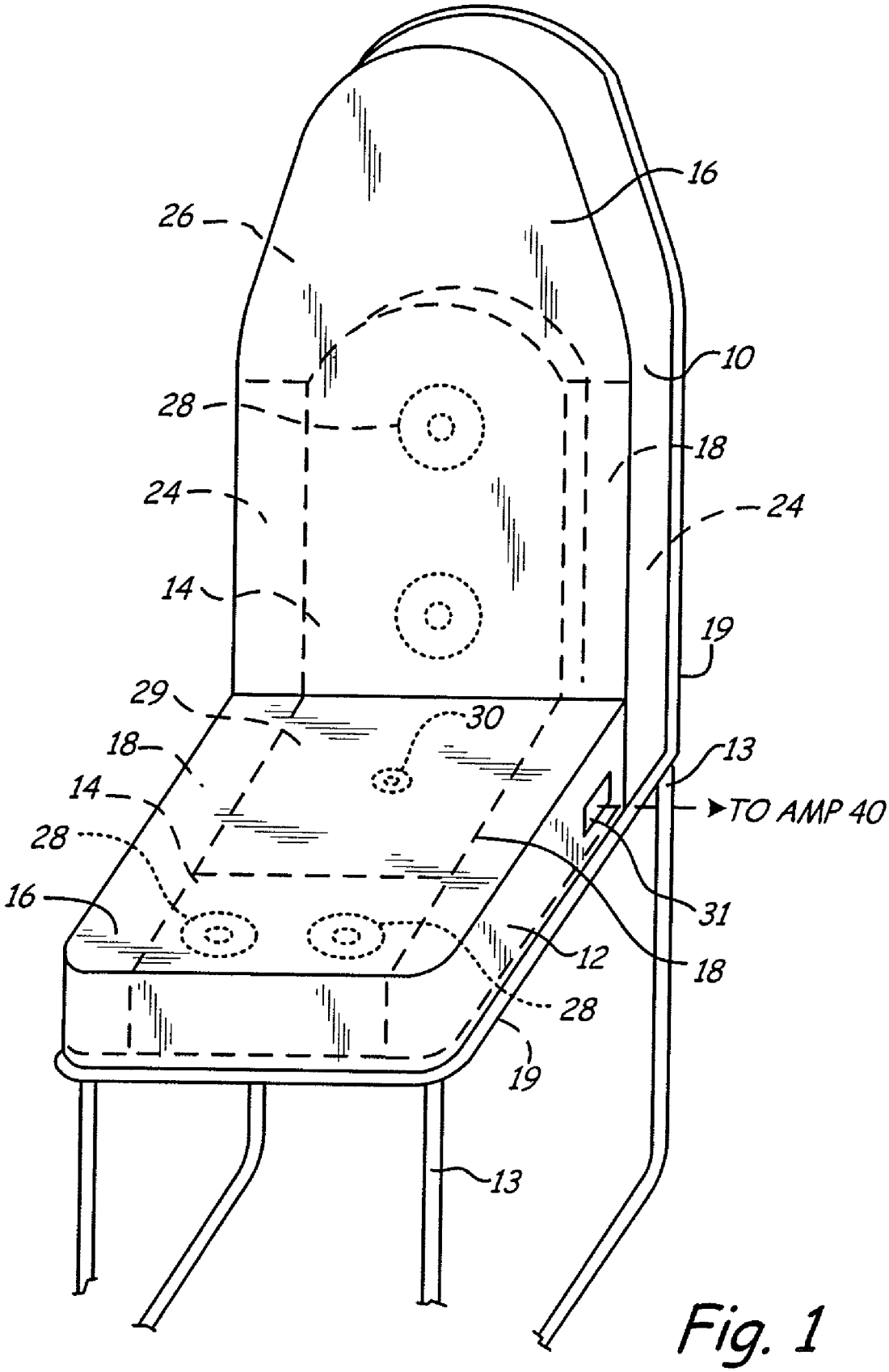
FIG. 1 is a perspective view of a chair incorporating aspects of the present invention.

The present invention is directed to a pad, chair assembly or other similar body-supporting structure that is capable of transmitting amplified sound and vibrations generated by a sound source to a user's body. As shown in FIG. 1, in one embodiment the subject invention includes a chair having a back pad 10 and a seat pad 12 and frame 13. Each pad 10, 12 is comprised of a covering layer 16, surrounding foam 18, and a speaker module 14. The speaker module 14 is disposed within the pad 10, 12 and is surrounded by the covering layer 16 and the surrounding foam 18. Speaker modules 14 each include a pair of speakers 28. In a preferred embodiment of the invention, a user's thighs would be located approximately above the two speakers 28 of seat pad 12, and a user's lower and upper spine would align with two speakers 28 of the back pad 10. A base 19 forms a lower layer of the pads 10, 12. In the illustrated embodiment, base 19 is a plywood element. In the illustrated embodiment, pads 10, 12 are adapted to be secured to a chair frame 13 using known securement devices, such as threaded fasteners engaging base 19, etc. In alternative embodiments, pads 10, 12 may simply rest upon an underlying support.

Embodiments of the present invention may be adapted for use with an electronics package including one or more activation switches 30, volume control switches (such as potentiometers) 31, and an amplifier 40. Amplifier 40 and/or volume control switches 31 may be internally disposed within pads 10, 12 or may be external to the pads and in electrical communication therewith. Those of ordinary skill in the art would appreciate a variety of different electronics packages useful to power the speaker 28 of pad 10, 12. For example, a wireless remote control may be utilized to control operation of an amplifier 40. In another example, amplifier 40 may be utilized to power additional speakers external to the pads 10, 12. The routing approaches of various cables necessary to power the speakers 28 and to communicate with switches 30, 31 within pads 10, 12 would be within the skills held by those of ordinary skill in the art.

Back Pad 10

Figure 2:
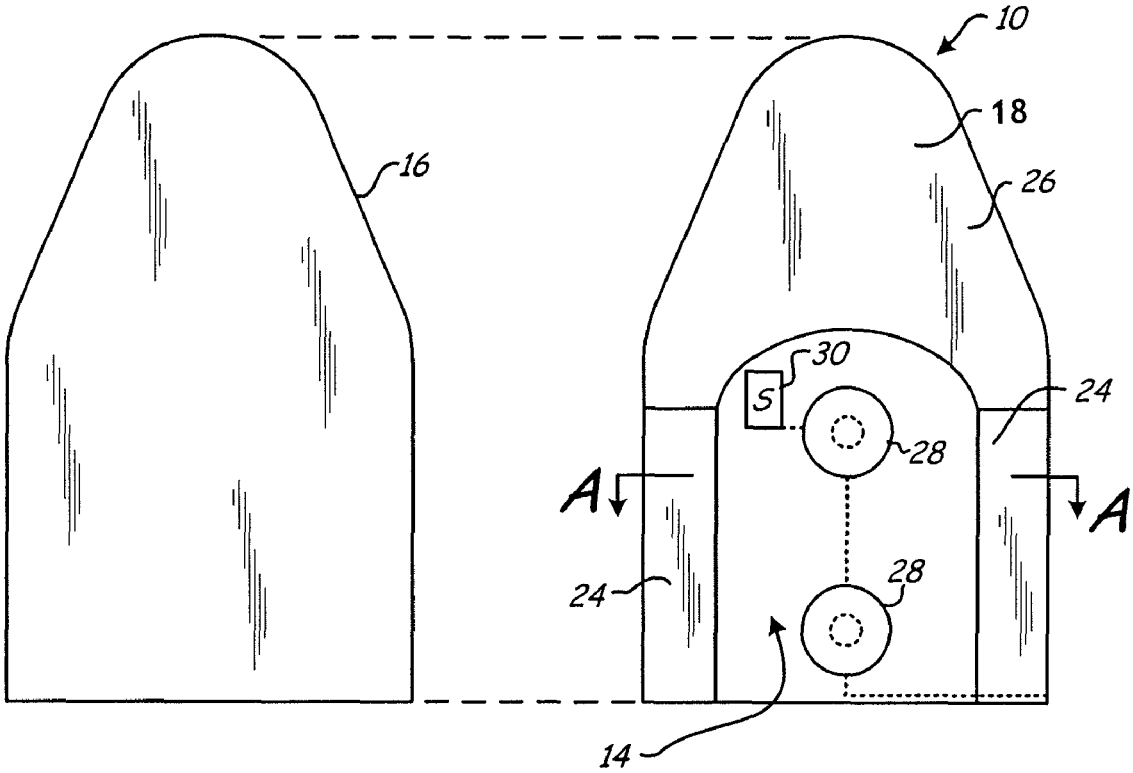
FIG. 2 is a side elevational view of a partially disassembled back pad of the chair of FIG. 1.
Figure 3:
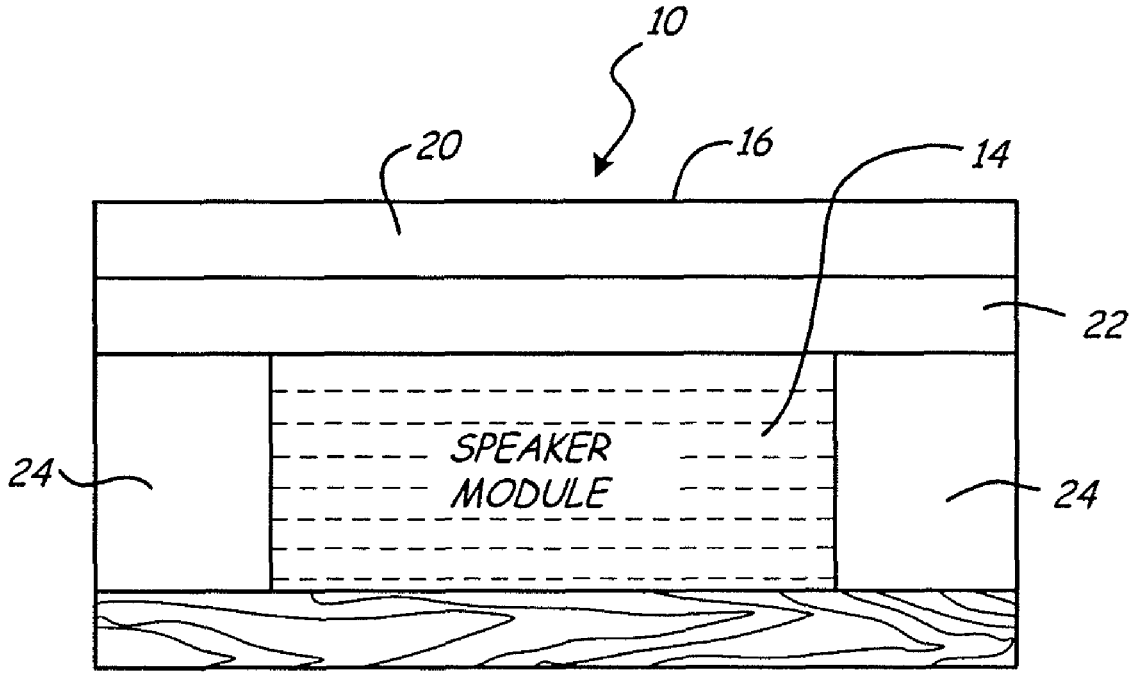
FIG. 3 is a cross sectional view the back pad taken along lines A-A of FIG. 2.
Figure 4:
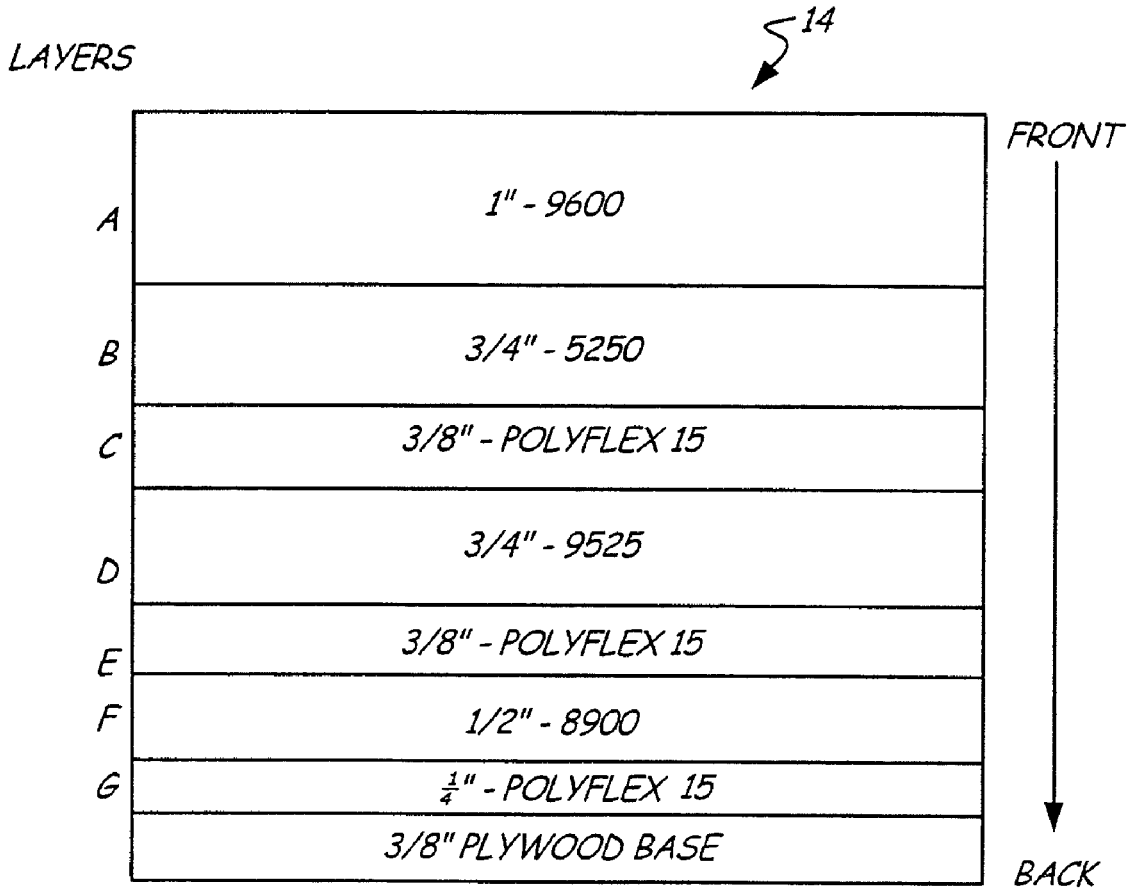
FIG. 4 is a diagrammatic view of the plurality of different layers comprising the speaker module of the back pad of FIG. 2.
Figure 5:
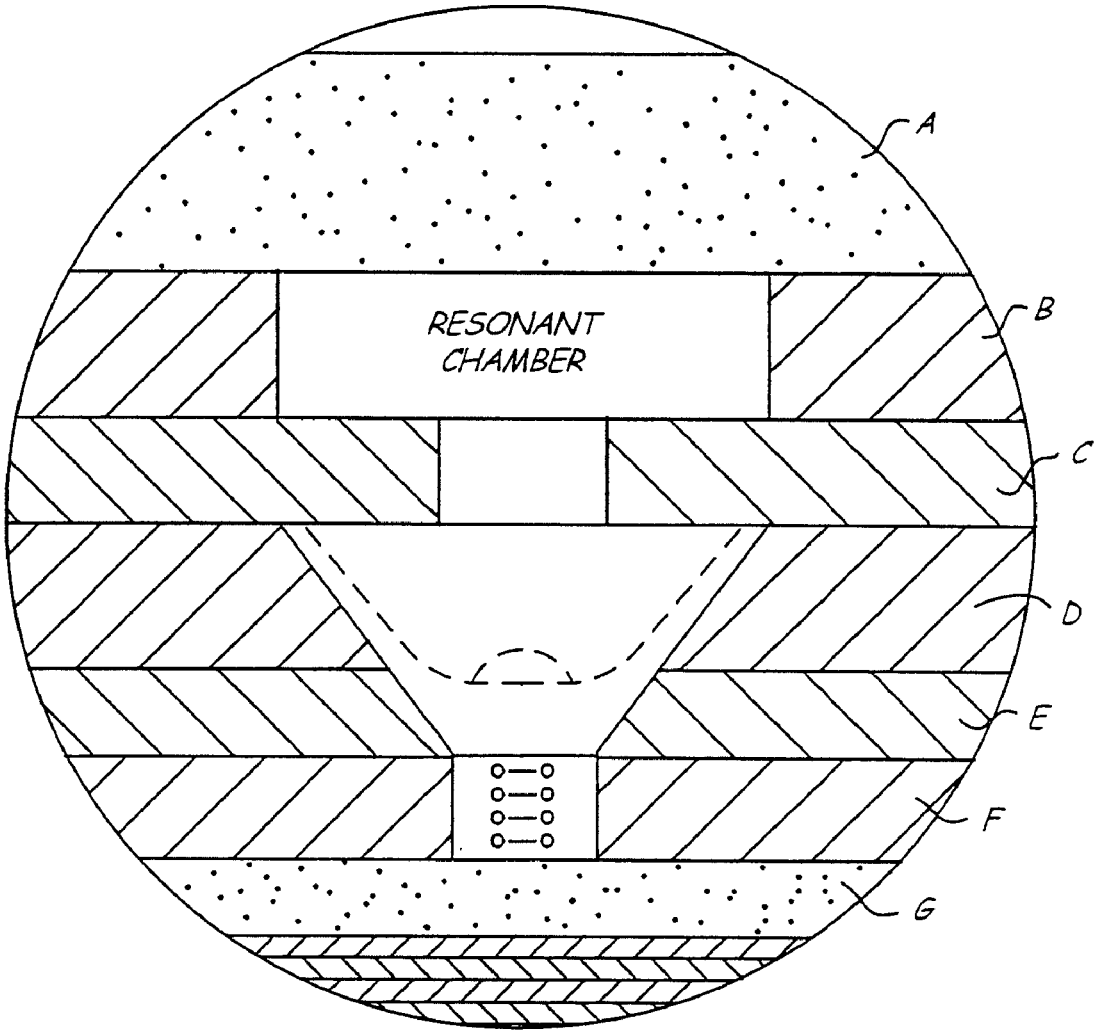
FIG. 5 is a diagrammatic view of the speaker module of the back pad of FIG. 2 illustrating placement of the speaker and resonant chamber within the speaker module of the back pad.
Figure 6:
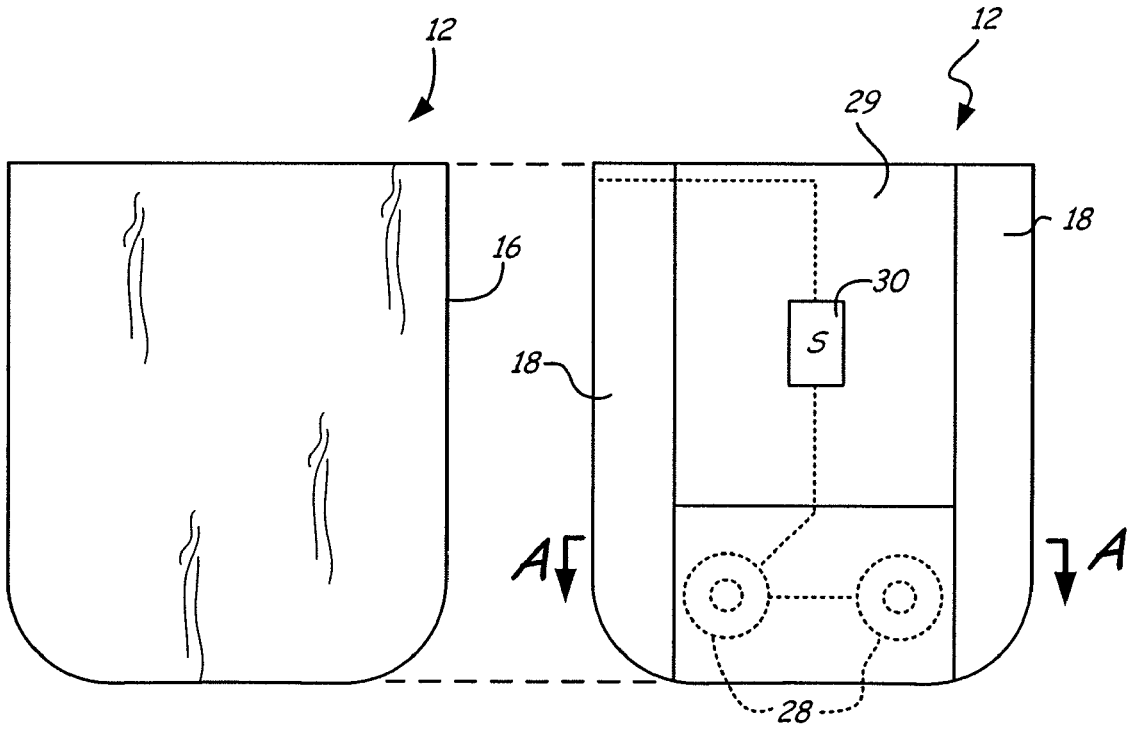
FIG. 6 is a top plan view of a partially disassembled seat pad of the chair of FIG. 1.
Figure 7:
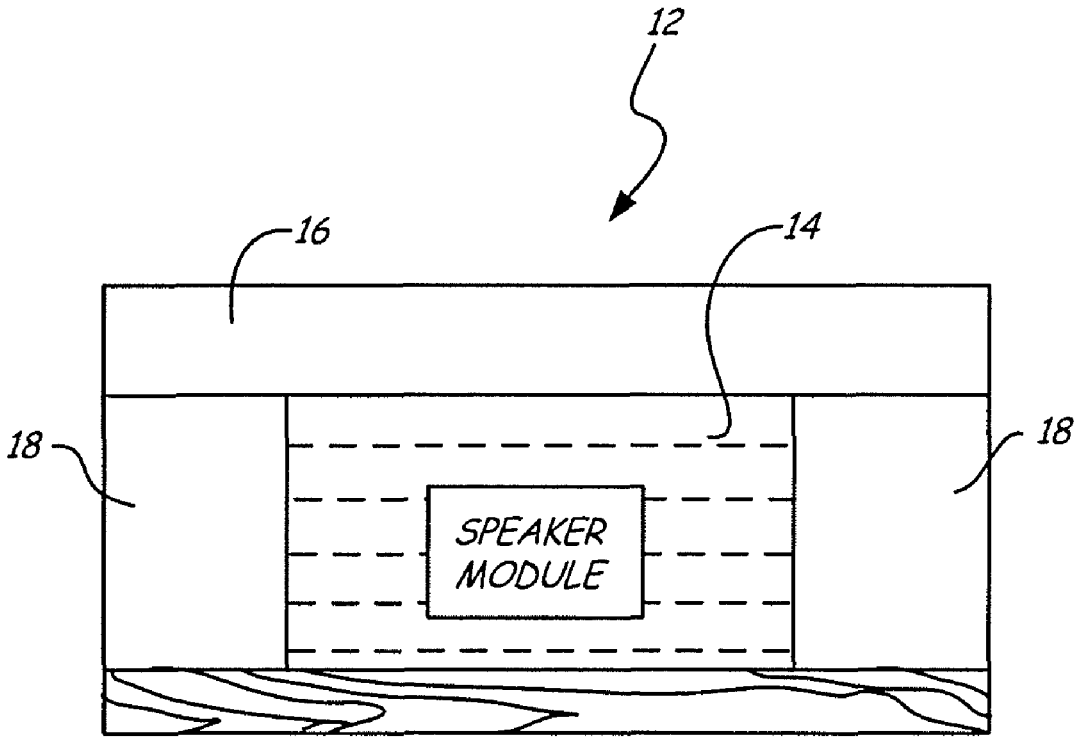
FIG. 7 is a cross sectional view the seat pad taken along lines A-A of FIG. 6.

FIGS. 2-5 illustrate elements of a preferred embodiment of a back pad 10 according to the present invention. FIG. 2 is a side elevational view of a partially disassembly back pad 10. FIG. 3 is a cross-sectional view of the back pad of FIG. 2 taken along lines A-A. FIG. 4 depicts various materials of construction of the speaker module 14 of back pad 10 of FIG. 2. FIG. 5 is a diagrammatic cross-sectional view taken through the speaker module 14 of back pad 10 of FIG. 2.

Referring to FIG. 3, in the illustrated embodiment of the back pad 10, the covering layer 16 is comprised of two layers, 20, 22. Both layers 20, 22 are designed to be very compressible to conform to the user's head and back for comfort purposes and to allow sound and vibration energy to pass with minimal filtration and obstruction. The top covering layer 20 is made of a highly porous material through which sound and vibrations can readily penetrate. The top covering layer 20 is preferably made of a reticulated polyurethane filter foam. The bottom covering layer 22 lies just under the topmost layer and is made of a ¾ ounce fiber that also has limited sound and vibration filtering. In comparison, the seat pad 12 has a covering layer 16 comprised of a single layer.

Referring to FIGS. 2 and 3, the surrounding foam 18 of back pad 10 has three elements, including two lateral elements 24 which are located on either side of the speaker module 14 and one top element 26 which is located substantially above the speaker module 14. The lateral elements 24 are approximately 4 inches in thickness approximating the thickness of the speaker module 14. The top element 26 is approximately 3⅝ inches thick, 14.5 inches at its greatest height and 23 inches at its greatest width. It is less thick than the speaker module 14 so that the user's upper back and shoulders can be positioned more comfortably in a more natural posterior position. Preferably, the foam and other material in the surrounding foam 18 must not substantially resist the user in leaning back so that it can afford greater comfort while sitting or reclining, as a person's shoulders and shoulder blade area are naturally positioned more posterior than the lumbar region in many people. Preferably, the foam used in the surrounding foam 18 is not as sound conductive as the elements of the speaker module 14. One preferred material for the surrounding foam 18 is a polyurethane foam material with a density of about 0.9 to 1.1 lbs/ft$^3$ and an indent force deflection at 25% of about 12 to 18, all properties measured using the ASTM D-3574-86 testing methods. An example of a suitable polyurethane foam for use in the present invention is "1675" Foam available from Amcon/VAS, Minneapolis, Minn., although other materials meeting these characteristics are also suitable for use in the present invention.

In one embodiment, the speaker module 14 for the back pad 10 includes foam to support and protect the speakers 28 and to maximize the conductance of sound and vibration to the user. In addition, the foam of speaker module 14 is a stiffer protective foam which provides more postural support than the softer surrounding foam 18. The thickness of the speaker module 14 and/or the covering layer 16 can be increased, particularly in the area proximal to the lowermost speaker to create further lumbar support. Alternatively, a lumbar support pillow can be used at this location.

FIG. 4 shows a layer-by-layer view of one embodiment of the speaker module 14 of the back pad 10. The layers of the pad of the present invention can be of any thickness suitable to support the user comfortably and through which sound and vibrations can be transmitted and experienced by the user. Although the layers can be of any thickness, it is preferable to minimize the separation between the speakers and the user's body to maximize the transmission of sound and vibration into the body. Layers A, B, C, D, E and F help to form chambers around the speakers and provide orientation and support for the speakers. The speaker chambers form a resonant chamber portion formed by apertures in layers overlaying the speaker. The resonant chamber space is air-filled between layers A and the speaker cone at the level of layer D.

Referring to FIGS. 2, 4 and 5, layers A and B also provide cushioning between the user and the speakers and stiffer foam of layer C, particularly at the back curved border of layer C where layer C is inset approximately ½ inch to reduce the likelihood that the user will feel the stiff edge. Layer B has full thickness circular holes 5 inches diameter, placed at the site of the resonant chambers. Layer C is a stiff foam layer with full thickness circular holes 2½ inches in diameter, placed at the site of the resonant chamber. These through holes aid in the transmission of sound energy and create a resonant space for sound and vibration. Layer D is a more flexible foam with through holes that house the speaker frame at the approximate level of the speaker cone. Layer A does not have through holes, as it is not only designed to transmit some of the sound and vibration energy directly towards the user, but also to spread some of the sound and vibrations throughout layer A in order to be felt more diffusely. Layer E is a stiff foam material in which the narrow portions of the speakers 28 are housed and the posterior border of the resonant chamber portion of the speaker chamber defined. The speaker housing chambers can be of any diameter. The speaker housing openings are preferably of a diameter suitable for securing the speakers used in the pad(s) and chair. Layer F is made of a material of density similar to layer D, and the back portion of the speakers are affixed hereto. Layer F also includes openings corresponding to the speaker chamber openings in layers B, C, D and E. The openings in Layer F preferably go all the way through the thickness of Layer F, but alternative embodiments are possible in which some or all of the openings in Layer F do not run the entire thickness of layer F and form a sort of well or cavity instead. Preferably, the thickness of layer F is approximately equal to the thickness of the magnet of the speaker to be positioned in the speaker chambers. The openings in layer F that are to receive the speakers preferably have a diameter somewhat less than the diameter of the speaker magnet. In one embodiment, the speaker 28 magnet has a diameter of about 3 inches and the corresponding speaker-receiving opening in layer F has a diameter of about 2.5 inches. Layer G is added behind or underneath layer F to provide a cushion effect adjacent to the back of the speaker magnet and to anchor the switch. Layer G is of the same stiff foam of layers C and E and can also reflect sound forward. Other variations of the opening positions and diameters are contemplated by the present invention, and may be varied to achieve a desired result.

In one embodiment the thickness of the layers will vary from ¼ inch to 2 inches. Preferably, layer C and layer E are narrower than layers A, B, D and F and are made of firmer material to transmit vibrations through the speaker module more efficiently. A sound reflective film can also be placed or adhered to the either surface of layers C and/or E to conduct more sound and vibration towards the body. In one preferred embodiment, layer A is about 1 inch thick, Layer B is about ¾ inch thick, layer C is about ⅜ inch thick, layer D is about ¾ inch thick, layer E is about ⅜ inch thick, layer F is about ½ inch thick and layer G is about ¼ inch thick.

In one embodiment, layer A is made of a more dense resonant material than that of layers B, D, and F, and functions as a resonating layer to spread and transmit vibrations emanating from the speakers. In this manner the vibration from the speaker module is spread throughout the pad/chair rather than just one point (speaker) source. One preferred material for layer A is polyurethane foam. In one preferred embodiment, layer A is made of a polyurethane foam material having a density of about 2.75 to 2.95 lbs/ft$^3$, an indent force deflection at 25% of about 30 to 36, a compression set of about 10%, a tensile strength of about 10 psi, a tear resistance of about 1 lbs/in, and an elongation of 100%, all properties measured using the ASTM D-3574-86 testing methods. An example of a suitable polyurethane foam for use in the present invention is "9600" Foam available from Amcon/VAS, Minneapolis, Minn., although other materials meeting these characteristics are also suitable for use in the present invention.

In one embodiment, layers B, D and F are made of polyurethane foam of varying flexibility with densities ranging from approximately 1.7 to 2.0 lbs/ft$^3$. Layer B has an indent force deflection at 25% of about 27 to 35, while that of layer D is about 30 to 38 and that of layer F is about 100 to 125, all properties measured using the ASTM D-3574-86 testing methods. An example of a suitable polyurethane foam for use in the present invention for Layer B is "5250" Foam, for layer D is "9525" Foam and for layer F is "8900" Foam available from Amcon/VAS, Minneapolis, Minn., although other materials meeting these characteristics are also suitable for use in the present invention.

In one embodiment, the wires and cabling are routed along a layer in order to incur less bending and breakage. The switch connections also occur at this level. This limits bending and potential breakage of the connections between wires and speakers, wiring and cables. Those of ordinary skill in the art would appreciate a variety of different wire bundling and/or routing approaches.

In one embodiment layers C, E and G are made of a more stiff or rigid material, which can transmit vibrations emanating from the speakers or other sound or vibration source. One preferred material for layers C, E and G is polyethylene foam. In preferred embodiments, layers C, E and G are made of a polyethylene foam material having a density of about 1.5 lbs/ft$^3$, a compressive strength at 25% of about 11, a vertical direction at 50% of about 20 psi, a compression set of about 16%, a tensile strength of about 39 psi, a tear resistance of about 15 lbs/in, a cell size of about 0.5 microns, and a buoyancy of about 60 lbs/ft$^3$, all properties measured using the ASTM D-3575 testing methods. An example of a suitable polyethylene foam for use in the present invention is "Polyflex 15" Foam available from Amcon/VAS, Minneapolis, Minn., although other materials meeting these characteristics are also suitable for use in the present invention.

A visco-elastic, polyurethane foam can also serve as an alternative for layer A and/or layer B. The characteristics of visco-elastic polyurethane foam allow for greater conductance of sound and vibration in addition to greater comfort. Using a visco-elastic polyurethane foam or another conductive material creates a more uniform sensation of sound and vibration from the entire surface of the speaker module. However, because this material compresses so significantly with prolonged pressure it offers less cushioning effect.

Preferably, the visco-elastic polyurethane foam used in an embodiment of the present invention has a density of between about 3.5 to 4.5 lbs/ft$^3$, an indent force deflection at 25% of between about 8-12, a tensile strength of about 10 psi, a tear strength of about 1.0 lbs/linear inch, and demonstrates 100% elongation, all properties measured using the ASTM D-3574-86 testing methods. An example of suitable visco-elastic polyurethane foam for use in the present invention is "SR38" Foam available from Amcon/VAS, Minneapolis, Minn., although other materials meeting these characteristics are also suitable for use in the present invention.

Seat Pad 12

In one embodiment, as shown in FIGS. 6 through 10, the seat pad 12 includes a seat module 29, a speaker module 14 and surrounding foam 18. The seat module 29 and the speaker module 14 share a common top layer which is akin to layer A of the back pad 10. The seat module 29 is constructed so that the user's weight will cause greater compression of the seat module 29, than the speaker module 14. This elevates the user's knees and crates a backward lean towards the back pad 10.

Figure 8:
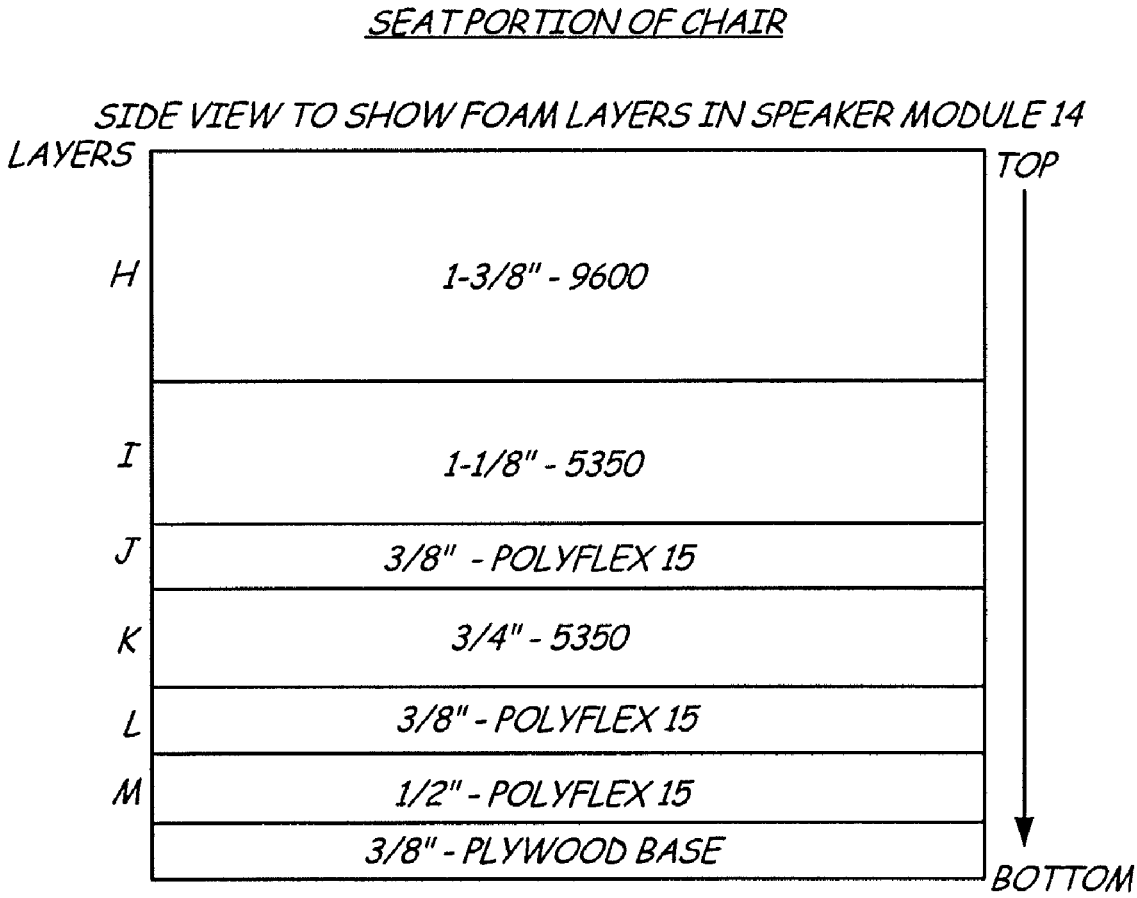
FIG. 8 is a diagrammatic view of the plurality of different layers comprising the speaker module of the seat pad of FIG. 6.
Figure 9:
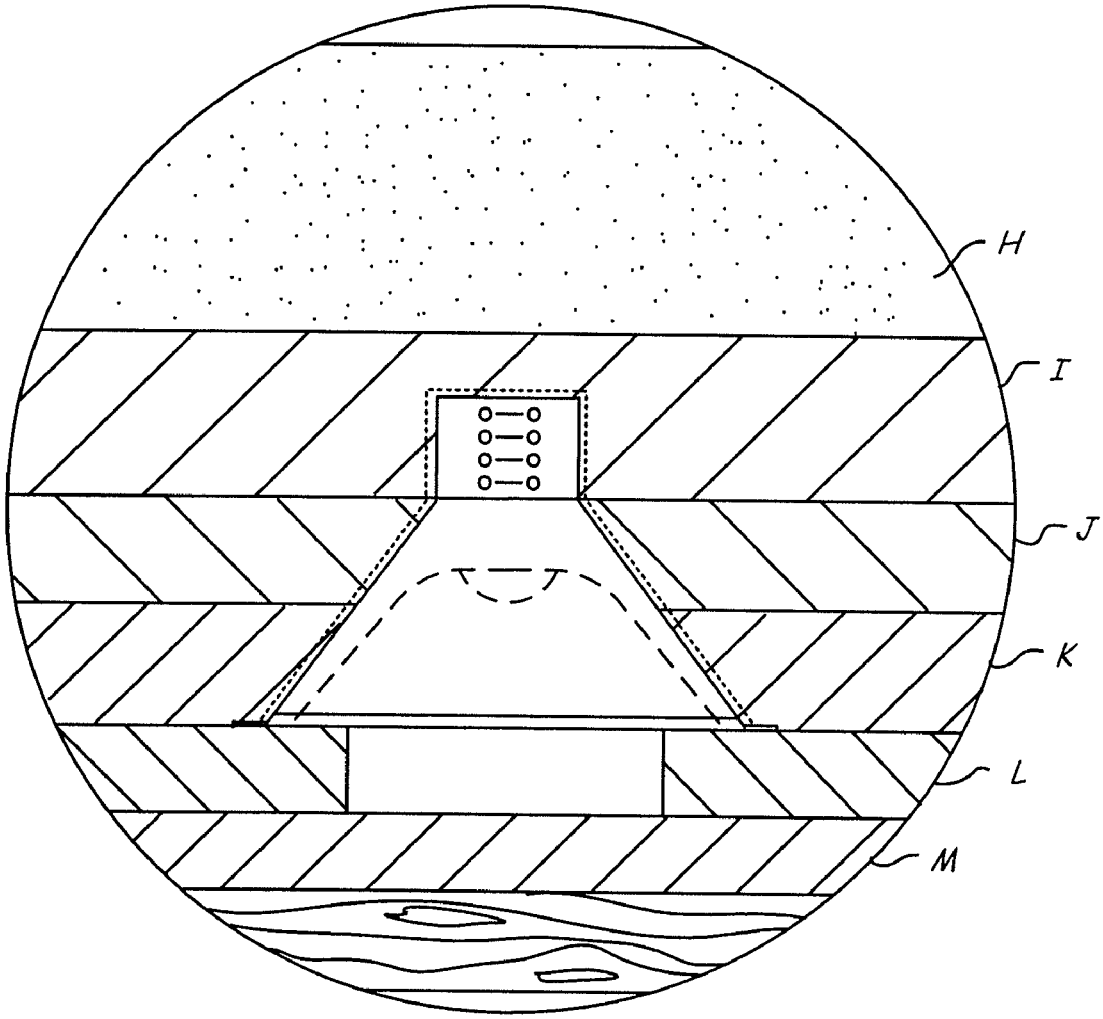
FIG. 9 is a diagrammatic view of the speaker module of the seat pad of FIG. 6 illustrating placement of the speaker in a downward direction and a resonant chamber within the speaker module of the seat pad.

In one embodiment, the speaker module 14 for the seat pad 12 is approximately 17 inches wide, 8 inches deep and 5½ inches high. As illustrated in FIGS. 8 and 9, the speaker module 14 of seat pad 12 includes layers H, I, J, K, L, and M. The space bordered on the bottom by layer M and on the top by layer J defines a resonant chamber. The resonant chamber space is air-filled between layer M and the speaker cone at the level of Layer K.

Layer M is a stiff foam material that has no through holes. Layer M is designed to conduct sound and vibrational energy. Layer L is a stiff foam material that has through holes of approximately 4 inches in diameter at the site of the resonant chambers. Layer L is designed to conduct sound and vibrational energy and also transmit sound energy to layer M and to the plywood layer and the metal frame when used. Layer K is a more flexible foam with through holes that house the speaker frame at the approximate level of the speaker cone. These through holes aid in the transmission of sound energy and create a resonant space for sound and vibration.

Layer J is a stiff foam material in which the narrow portions of the speakers are housed and the back border of the resonant chamber portion of the speaker chamber defined. The speaker housing chambers can be of any diameter. The speaker housing openings are preferably of a diameter suitable for securing the speakers used in the pad(s) and chair.

Layer I is made of a material of density similar to layer K, and the back portion of the speakers are affixed hereto. Layer I also includes openings corresponding to the speaker chamber openings in layers J, K, and L. The openings in layer I preferably go all the way through the thickness of layer I, but alternative embodiments are possible in which some or all of the openings in layer I do not run the entire thickness of layer I and form a sort of well or cavity instead. Preferably, the thickness of layer I is approximately equal to the thickness of the magnet of the speaker to be positioned in the speaker chambers. The openings in layer I that are to receive the speakers preferably have a diameter somewhat less than the diameter of the speaker magnet. In one embodiment, for example, the speaker magnet has a diameter of about 3 inches, the corresponding speaker-receiving opening in layer M has a diameter of about 2.75 inches.

Layer H is made of a more dense material than that of layers I and K and has a tendency to spread and transmit vibrations emanating from the speakers or other sound or vibration source. In this manner the vibration from the speaker module becomes somewhat more homogeneous.

Generally, the thickness of the layers will vary from ⅜ inch to 3 inches. Preferably, layers J, L and M are narrower than layers H, I, and K are made of firmer material to transmit vibrations through the Speaker module more efficiently. A sound reflective film can also be placed or adhered to the either surface of layers J, L and/or M to conduct more sound and vibration. In one preferred embodiment, layer H is about 1⅜ inch thick, layer I is about 1⅛ inch thick, layer J is about ⅜ inch thick, Layer K is about ¾ inch thick, layer L is about ⅜ inch thick, and layer M is about ½ inch thick.

One preferred material for layer H is polyurethane foam previously described as "9600." One preferred material for layers I and K is a polyurethane foam material with a density of about 1.8 to 2.0 lbs/ft$^3$ and an indent force deflection at 25% of about 50 to 60, all properties measured using the ASTM D-3574-86 testing methods. An example of a suitable polyurethane foam for use in the present invention is "5350" Foam available from Amcon/VAS, Minneapolis, Minn., although other materials meeting these characteristics are also suitable for use in the present invention. One preferred material for layers J, L and M is polyethylene foam labeled and previously described as "Polyflex 15."

Figure 10:
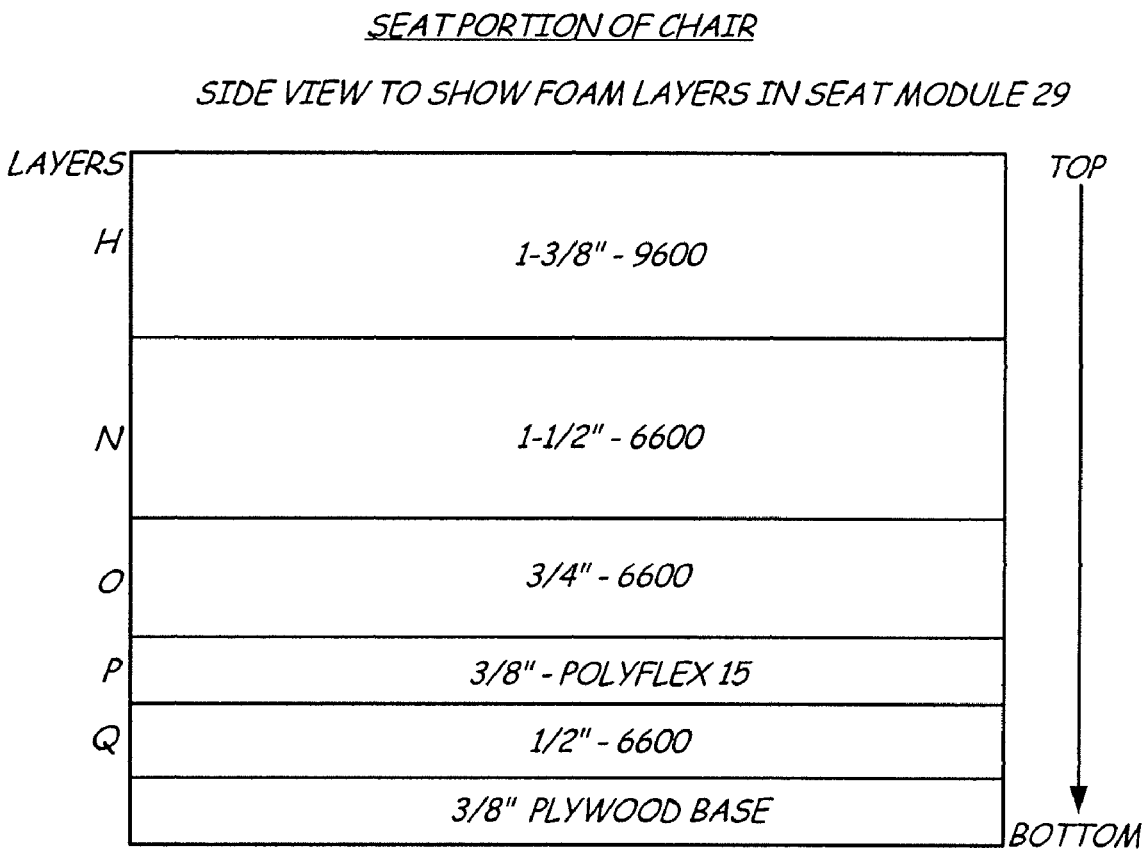
FIG. 10 is a diagrammatic view of the plurality of different layers comprising the seat module of the seat pad of FIG. 6.

Component layers of the seat module 29 are illustrated in FIG. 10, and include layers H, N, O, P, Q. In one embodiment the seat module 29 is approximately 17 inches wide, 11 inches deep and 5.5 inches high. The seat module 29 is constructed to maximize comfort and support, while transmitting the sound and vibrational energy to the user. The polyurethane foams are chosen for increasing indent force deflections from the top surface (including the covering layer 16) to layer O just above the stiffer foam of layer P for greater softness closer to the user's body and reduced likelihood of the material compressing to the point of bottoming out such that the user would feel the stiffness of layer P. The seat module 29 is constructed so that although the user's weight is well supported, there will be greater compression versus the speaker module 14 such that the user's knees are elevated relative to his or her hips and the user assumes a position of backward lean. This position is more comfortable than a strict level positioning particularly when the lumbar spine is well supported.

Layer P is an extension of layer L of the speaker module 14 so that the wires and cabling could be routed at the same level in order to incur less bending and breakage. The switch connections also occur at this level. Also layer H of the seat module 29 extends to become layer H of the speaker module 14. These unbroken layers of foam, which connect the speaker and seat modules when glued to their adjacent layers creates an interdigitation that secures both modules together more than if there were a clean division between the modules. This also limits bending and potential breakage of the connections between wires and speakers, wiring and cables.

The switch is supported by holes cut into layers P and Q. The switch plate is located between layers N and O and is the reason why these 2 layers are not manufactured as one. The post partially protrudes into a corresponding hole cut in layer O. Layer Q is flexible foam chosen for compressibility to increase comfort. In another embodiment, particularly when the plywood base is not used, layer Q maybe a continuation of layer M in the speaker module 14.

Generally, the thickness of the layers will vary from ⅜ inch to 3 inches. Preferably, layer P is narrower than layers H, N and O, and is made of firmer material to transmit vibrations through the speaker module more efficiently. A sound reflective film can also be placed or adhered to the either surface of layers P to conduct more sound and vibration towards the body. In one preferred embodiment, layer A is about 1.375 inch thick, layer N is about 10.5 inches thick, layer O is about 0.75 inch thick, layer P is about 0.375 inch thick, and layer Q is about 0.5 inch thick.

One preferred material for layer H is polyurethane foam previously foam previously described as "9600". One preferred material for layers N, O, and Q, is a polyurethane foam material with a density of about 2.5 to 2.7 lbs/ft3, an indent force deflection at 25% of about 59 to 71, a compression set of about 10%, a tensile strength of about 15 psi, a tear resistance of about 1.5 lbs/in, and an elongation of 150%, all properties measured using the ASTM D-3574-86 testing methods. An example of a suitable polyurethane foam for use in the present invention is "6600" Foam available from Amcon/VAS, Minneapolis, Minn., although other materials meeting these characteristics are also suitable for use in the present invention. One preferred material for layer P is polyethylene foam labeled and previously described as "Polyflex 15."

The lower pad or seat portion 12 of the chair is assembled by positioning the speakers 28 in layer J of the speaker module 14 and then attaching layers K, L, and M. The speaker cables are attached to bottom top surface of layer J and are preferably wrapped together to form a single robust cable. Layer I is then positioned on top of layer J. Layer Q of the seat module 29 is then affixed to the underside of layer P (layer L of the speaker module 14). Layers O and then N of the seat module 29 are then attached. Layer H is then added to the top of both modules 14, 29. An adhesive attaches the layers to each other, the surrounding foam 18 to the sides of the speaker and seat modules 14, 29 and the covering layer 16 to the top of layer H and the corresponding side of the surrounding foam 18. In one embodiment layer M of the speaker module 14, layer L of the seat module 29 and the corresponding side of the surrounding foam 18 is glued to a ⅜ inch plywood base, which is used to secure the speaker module 14, seat module 29, surrounding foam 18 and covering layer to metal framing to create a chair structure. The speaker modules 14, seat module 29 and surrounding foam 18 along with the plywood base are all preferably housed in a removable outer cover. The outer cover is preferably washable or can be cleaned, and as described above, is made of fabric or a material that does not cause excessive interference in the transmission of the sound waves from the speakers to the user's body. Openings are placed on both lateral sides of the covers to that the pad cable can be drawn out either side for convenience.

Surrounding foam 18 of seat pad 12 is preferably not as sound conductive as the elements of the speaker module 14. One preferred material for the surrounding foam 18 is a polyurethane foam material with a density of about 0.9 to 1.1 $lbs/ft^3$ and an indent force deflection at 25% of about 12 to 18, all properties measured using the ASTM D-3574-86 testing methods. An example of a suitable polyurethane foam for use in the present invention is "1675" Foam available from Amcon/VAS, Minneapolis, Minn., although other materials meeting these characteristics are also suitable for use in the present invention.

Frame:

As depicted in FIG. 1, frame 13 is a tubular metal frame. In alternative embodiments, frame 13 may be made of different materials or combinations of materials. A rigid frame 13 further enhances the amount of vibration, particularly high frequency sound, that is transmitted to the user. This is of benefit as some amount of the higher frequency sound waves is filtered out by one or more materials of the speaker module, seat module or surrounding foam. The amplifier 40 of the present invention preferably has either a treble adjust for the user to adjust the high frequency content to compensate for high frequency attenuation or has the treble adjustment fixed and thereby not requiring adjustment with a bias towards greater amplification of the higher frequencies.

In another embodiment of the present invention, a recline mechanism is provided to adjust the relative orientation between the back pad 10 and seat pad 12. Additionally, a swivel mechanism may be provided to permit angular rotation of portions of the chair relative to the ground surface.

The back and lower pad, or portions thereof, can be positioned on the floor or upon other surfaces or furniture or alternatively incorporated, as a module, into another structure that supports the user. When the pads are positioned on the floor or upon other surfaces the vibration is reduced as some of the sound energy is absorbed in part by whatever they are resting upon. This effect is magnified if the pads are placed upon a more absorptive substance such as bedding or carpet. To enhance the vibrations that are experienced by the user it is useful to place the pads in a structure that enhances transmission of the sound and resultant vibrations to the user. The greater the density of the material used therefore, the greater amount of sound and vibration that is transmitted, as less dense materials absorb more of the sound energy.

Electronics:

In the illustrated embodiment of the present invention, electronic devices are utilized to communicate signals to speakers 28 and an amplifier 40. Those of ordinary skill in the art would appreciate that a variety of different amplifiers and associated hardware may be utilized to provide functional control of speakers 28. Aspects of a preferred embodiment of the invention are provided below.

Figure 11:
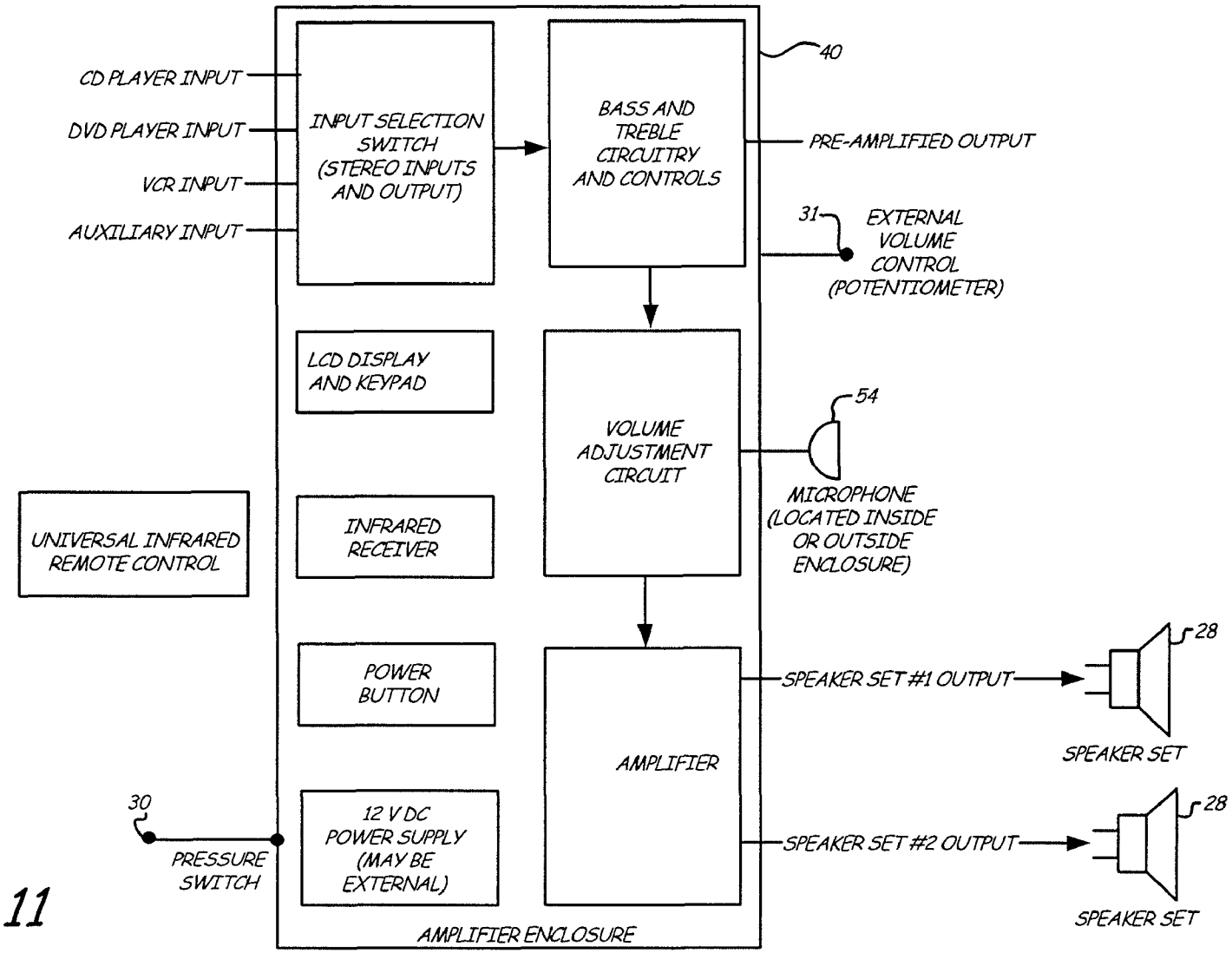
FIG. 11 is a block diagram of an electronics package suitable for use with the chair of FIGS. 1-10.

One or more switches 30 may be utilized to control amplifier 40. One or more manually adjustable volume control devices may also be utilized. As shown in FIG. 11, in one embodiment, the speakers 28 are connected to an amplifier 40 that accepts audio output from a VCR, DVD, CD or MP3 player, or other electronic devices that have audio output capabilities. The audio output of the amplifier 40 can be sent to the user's TV or stereo receiver (connected to other external speakers) instead of or in addition to the pad. The amplifier 40 includes an automatic volume adjustment mechanism which adjusts the volume of the sound to be transmitted through the pad(s), chair and air.

In one embodiment, a variable resistor network or potentiometer is provided to control the sound volume generated by speakers 28. Potentiometers may be presented to the user at a side panel, for example. Alternatively, an additional amplifier can be utilized to amplify one or more speaker 28 signals to control the volume of respective speakers 28.

In one embodiment the amplifier 40 may control sound generation to multiple chairs. In such an instance, amplifier 40 may contain independent controls for each chair that it is connected to. The pads 10, 12 of each chair may be independently controlled in regards to volume, balance within the unit as each pad or portion of the chair is an independent channel, base, treble, automatic volume settings and input sound source. Manufacturing an amplifier with independent controls is a more cost-effective and space efficient solution, as opposed to using separate amplifiers, as any redundant amplifier stages and/or sound monitoring circuits are powered by a common power supply, controlled by common control mechanisms and enclosed by a common enclosure. This amplifier can also be used to provide a sound signal to speakers independent of the pad(s) and/or chair(s) in order to control those speakers independently from the pad(s) and/or chair(s).

In one embodiment, pressure, light or heat sensitive activation switches 30 are placed on or in the pad(s) or chair. In one embodiment of the present invention the switch 30 is open (sound sources will then not transmit sound) until pressure is placed against the pad(s) or a portion of the chair thereby closing the circuit. Switches can be inserted in the circuitry for each of the sound sources within each of the pads or back or seat portions of the chair such that only the sound sources receiving the triggering signal will emanate sound. This methodology serves as an on/off mechanism for the entire pad or chair or portions thereof. These methods of use are particularly helpful when multiple transmitting pads or chairs are all connected to a sound or music source, but only some of the pads or chairs are in use (engaged by a user) or in partial use. Such situations include, but are not limited to, movie theaters, automobiles, office spaces and homes with multiple users. Manual switches can also be used in the place of automatic switches on or in the pad(s) or chair for this function.

In one embodiment a pressure sensitive switch 30 is placed in each pad or back and seat portion of the chair to control each channel independently. The pressure required to trigger (close the circuit) the switch is 567 grams and the switch life is 200,000 cycles. Switches requiring substantially greater force to close the circuit are too insensitive, particularly in the back pad (back portion of the chair), as they would force the user to position themselves awkwardly on the pad or chair in order to apply sufficient triggering pressure against the switch. Switches that are too sensitive and don't have sufficient spring force may not quickly or reliably open the circuit when pressure is removed. Switches that can't perform reliably for more than a reasonable number of cycles should not be used, as they may necessitate repair or create obsolescence. An example of a suitable switch for use in the present invention is a "C & K A series general purpose snap-acting switch" available from The Bergquist Company, Chanhassen, Minn., although other devices meeting these characteristics are also suitable for use in the present invention.

In one embodiment, rigid planar structure such as a plate or film is placed between the switch mechanism and the user's body so that pressure from the user's body can more easily triggering the switch. A post (comprising a rubber foot), protrudes through a corresponding hole in the foam layer directly above the switch is adhered to a plastic disc (located one layer more proximal to the user's body). In this embodiment the post is about ⅜ inch long and ½ inch in diameter, while the disc is approximately 2 inches in diameter. Different sized posts and plates can be used. The greater resiliency of the foam in between the plate (plastic disc) and the switch assists the switch in achieving an open position when pressure is removed as the foam between the switch and the plate acts as a supplementary spring. The switch may be supported by holes cut into layers E and F. The switch plate is located between layers C and D with the post partially protruding through a corresponding hole cut in layer D.

In addition to optimizing sound and vibration to the user's body and not ears, using the system of the present invention also requires that the user is able to be comfortably positioned for hours, as occurs when watching TV or a movie or playing video games. Because the pad(s) or chair produces sound and vibration the user will tend to remain in a given position for periods of time that are longer than would otherwise be the case when simply performing these activities in a seat that does not produce sound and vibration. This occurs because the user will tend to find a position that optimizes the sound and vibration to their liking. As a result, since the user is likely to make fewer bodily adjustments to relieve discomfort from pressure or reduced blood flow, it is necessary to create pads and chairs that provide excellent comfort by properly supporting and cushioning the user's body. Therefore, foam softness, support and resiliency, as well as shape and contour of the seat and back pads or portions of the chair are critical to the user's experience.

The speakers 28 can be any type of conventional stereo speaker. Alternatively, other sound/vibration-emitting devices can be used. In the embodiment shown in the Figures, a commercially available stereo speaker having an outermost diameter of 5¼ inches was used. Generally, any commercially available speaker can be used in the present invention, and preferably speakers that can transmit a range of frequencies from about 20 hertz to 20,000 hertz are used. In one embodiment, two additional speakers are added in the back pad or back portion of the chair to transmit sound from an amplifier that provides surround sound. Separate cabling is required from the surround sound-providing amplifier, which can also include a means to adjust the volume of these speakers. Alternatively, the additional speakers with surround sound connections can be incorporated into the lower pad or seat portion of the chair.

Since pressure is applied to the front of the speaker assembly, protective measures are taken to avoid damage to the speaker cone. To protect the speaker cone a circle of more rigid material (¼-inch high rigid foam in one embodiment) is adhered to the frame between the rubber material that suspends the cone and the outer front edge of the frame (5/16-inch thickness—between inner and outer diameter). In one embodiment of the present invention, this ring of more rigid foam abuts against a layer of rigid polyethylene foam in front of it (layer C) preventing any material from protruding into and damaging the speaker cone.

In one embodiment the connections (pad cable to speaker) of each speaker 28 are oriented towards one another. In this manner the top speaker is facing so that the connections are facing downwards, while the opposite is true for the lower speaker. The connections are oriented in this manner to limit the amount of bending and therefore, potential damage that can occur at these connections and to the wires leading from these connections because less compression force is applied to the pad in the space between the speakers during use. It is important to optimize the intensity of the sound stimulus, but yet avoid harmful exposure to the ear. Recorded music, TV broadcasts and soundtracks on tapes and DVDs typically have significant fluctuations in volume. Therefore, a single volume setting results in variable intensity of stimulus exposure when using these media with the decibel level at times far exceeding the desired level and at times being too low to hear. Therefore, an amplification control system with automated volume adjustments based upon the output of a decibel meter or sensor enables the user to automatically optimize his or her sound experience, without the need to manually adjust the volume setting. This can more readily be accomplished using the present invention as the sound source(s) is proximal to the user(s).

Embodiments of the present invention may include the placement of a decibel sensor 54 within the amplifier or remote to the amplifier and more proximal to the user. The latter embodiment is preferred with multiple users. This sensor transmits a signal corresponding to the decibel level to a microprocessor, which executes an algorithm designed to maximize intensity of stimulus exposure, but to not exceed a user defined level. Therefore, hearing loss/ear damage can be avoided, while providing a maximum user-defined intensity. A minimum level can also be specified so that harder to hear segments can be further amplified if desired. Levels can be set by either setting upper and lower threshold decibel numbers or one decibel number (mean) with a range number (plus and minus from the mean that each serve as upper and lower threshold numbers respectively when added to and subtracted from the mean). The output of the microprocessor is transmitted to a controller, which automatically adjusts the level of amplification. The user has the ability to disengage the system manually or remotely. This system is particularly useful when the user engages (sits, lies on or leans against) the pad(s) or chair and there is a need for rapid volume adjustment or when abrupt changes occur in the broadcast, soundtrack, music, etc. The amplifier and/or remote unit can also be supplied with a digital readout of the decibel level in the event that the user disengages the automatic adjustment means in favor of manual volume level setting.

Method of Pad Construction:

The back pad 10 is assembled by positioning the speakers in layer E and then attaching layer F to the back of layer E and layer G to the back of layer F, when used. The speaker cables are attached to the front side of layer E and are preferably wrapped together to form a single robust cable. Layer D is then positioned on top of layer E, layer C on top of layer D, layer B on top of layer C and layer A on top of layer B. An adhesive attaches the layers to each other, the surrounding foam 24 to the speaker module 14 and the covering layers 16 to the top of layer A and the corresponding side of the surrounding foam 24. In one embodiment layer G of the speaker module 14 and the corresponding side of the surrounding foam 24 is glued to a ⅜ inch plywood base, which is used to secure the speaker module 14, surrounding foam 24 and covering layers 16 to metal framing to create a chair structure. The entire foam and speaker assembly, and the plywood base when used, is preferably housed in a removable outer cover. This aids in the manufacturing process as manufacturing a cover is simpler and more cost-effective than the more expensive and time-consuming process of upholstering. The outer cover is preferably washable or can be cleaned, and as described above, is made of fabric or a material that does not cause excessive interference in the transmission of the sound waves from the speakers to the user's body. Openings are placed on both lateral sides of the covers so that the pad cable can be drawn out either side for convenience.

The lower pad 12 or seat portion of the chair can be constructed similarly to the back pad or back portion of the chair. Another embodiment consists of a covering layer 16, surrounding foam 18, and a downward oriented speaker 28 within speaker module 14. In this embodiment the speaker module 14 is oriented such that the speaker cone is directed downward, away from the user towards the bottom of the pad 12. The sound energy and vibrations are carried through the denser foam layers and plywood and metal when used.

Additional Features:

In another embodiment the speakers 28 in each pad 10, 12 do not comprise an independent left or right channel, but instead are assigned to either (one or more speaker to each) left and right channels to maintain the left channel on the left side of the user and the right channel on the right side of the user. In this embodiment either a common switch can be used to control both channels, single switches for each channel or individual switches for each speaker. The switches that control either the entire system or each channel can be placed in either the back or lower pad or either portion of the chair.

Alternative Embodiments

As described in the illustrated embodiments, pads 10, 12 are associated with a chair structure. In alternative embodiments, pads 10, 12 may together, or individually be associated with other types of body-supporting structures, such as sofas, couches, vehicle seats, benches, etc. While not required, pads 10, 12 are optimally connected to a rigid frame of the associated body-supporting structure. In alternative embodiments, pads 10, 12 may be portable and separable from each other.

Various modifications of this invention will be apparent to those skilled in the art. Thus, the scope of this invention is to be limited only by the appended claims. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A chair comprising:

a seat portion comprising a vibration source; and, a back portion comprising a speaker, a layered plurality of materials, and a resonant chamber, wherein at least a portion of the resonant chamber is defined within an aperture extending through at least one material of the layered plurality of materials, and wherein at least a portion of said aperture is configured to be positioned between the speaker and a user sitting in the chair.

2. The chair of claim 1, wherein the layered plurality of materials comprises a plurality of different foam elements.

3. The chair of claim 2, wherein the different foam elements have different degrees of compressibility.

4. The chair of claim 2, wherein the different foam elements have different degrees of acoustic conductance.

5. The chair of claim 1, wherein the speaker and the vibration source can each be independently controlled by the user.

6. The chair of claim 1, wherein the back portion of the chair comprises a plurality of speakers.

7. The chair of claim 6, wherein each speaker can be independently controlled by the user.

8. The chair of claim 1 further comprising an amplified sound source having an automatic volume control.

9. The chair of claim 8 further comprising a decibel sensor in communicationwith the automatic volume control.

10. The chair of claim 1 further comprising at least one activation switch located within the back portion, the seat portion, or both, the activation switch being in communication with an amplification system.

11. A chair comprising:

a seat portion comprising a vibration source; and a back portion comprising a speaker and a resonant chamber, said back portion and said seat portion each comprising a layered plurality of materials, wherein at least a portion of the resonant chamber is defined within an aperture extending through at least one material of the layered plurality of materials in the back portion of the chair, and wherein at least a portion of said aperture is configured to be positioned between the speaker and a user sitting in the chair.

12. The chair of claim 11, wherein the layered plurality of materials comprises a plurality of different foam elements.

13. The chair of claim 12, wherein the different foam elements have different degrees of compressibility.

14. The chair of claim 12, wherein the different foam elements have different degrees of acoustic conductance.

15. The chair of claim 11, wherein the speaker and the vibration source can each be independently controlled by the user.

16. The chair of claim 11, wherein the back portion of the chair comprises a plurality of speakers.

17. The chair of claim 16, wherein each speaker can be independently controlled by the user.

18. The chair of claim 11 further comprising an amplified sound source having an automatic volume control.

19. The chair of claim 18 further comprising a decibel sensor in communication with the automatic volume control.

20. The chair of claim 11 further comprising at least one activation switch located within the back portion, the seat portion, or both, the activation switch being in communication with an amplification system.

* * * * *